US005583533A

United States Patent [19]

Moriyama

[11] Patent Number: 5,583,533

[45] Date of Patent: Dec. 10, 1996

[54] CROSSTACK REDUCING METHOD OF DRIVING AN ACTIVE MATRIX LIQUID CRYSTAL DISPLAY

[75] Inventor: Hiroaki Moriyama, Tokyo, Japan

[73] Assignee: NEC Corporation, Tokyo, Japan

[21] Appl. No.: 17,388

[22] Filed: Feb. 12, 1993

[30] Foreign Application Priority Data

Feb. 12, 1992 [JP] Japan ..... 4-024183

[51] Int. Cl.[6] ..... G09G 3/36

[52] U.S. Cl. ..... 345/94; 345/89

[58] Field of Search ..... 340/784, 805, 340/765; 359/54, 55, 57, 56; 345/87, 89, 92, 94, 97, 95, 96

[56] References Cited

U.S. PATENT DOCUMENTS

| | | | |
|---|---|---|---|
| 4,638,310 | 1/1987 | Ayliffe | 345/94 |
| 4,681,404 | 7/1987 | Okada et al. . | |
| 4,705,345 | 11/1987 | Ayliffe et al. | 340/784 |
| 5,136,282 | 8/1992 | Inaba et al. | 340/805 |
| 5,157,387 | 10/1992 | Momose et al. | 340/805 |
| 5,247,376 | 9/1993 | Wakai | 345/95 |

OTHER PUBLICATIONS

"Eliminating Crosstalk in Thin Film Transistor/Liquid Crystal Displays", *1988 International Display Research Conference,* 1988 IEEE, By W. Howard et al., pp. 230–235.

*Primary Examiner*—Richard Hjerpe
*Assistant Examiner*—Chanh Nguyen
*Attorney, Agent, or Firm*—Young & Thompson

[57] ABSTRACT

The invention provides a driving method of an active matrix liquid crystal display. Alternating pulse voltage signals synchronizing with gate control pulse voltage signals are applied on data lines. Predetermined positive and negative constant voltages are applied on data lines in an initial time interval. The constant voltages to be applied on adjacent two lines have inverse polarities relative to one another, which are independent of image data. Subsequently, voltage signals corresponding to image data are applied on the data lines in a latter time interval, each of which has a voltage level corresponding to a gray level of a pixel in the display. The voltage signal has the same polarity as the constant voltage.

8 Claims, 10 Drawing Sheets

$V_{Gi}$ $V_{Gi+1}$ $V_{Gi+2}$ $V_M$ $V_{DATA}$
0
$V_i$
$V_{i+1}$
$V_{i+2}$
$V_M-V_i$
$V_M-V_{i+1}$
$V_M-V_{i+2}$

CROSSTACK REDUCING METHOD OF DRIVING AN ACTIVE MATRIX LIQUID CRYSTAL DISPLAY

BACKGROUND OF THE INVENTION

The invention relates to a method of driving a liquid crystal display, and more particularly to a method of driving an active matrix liquid crystal display including thin film field effect transistors and liquid crystal cell capacitors.

Recently, active matrix liquid crystal display have become attractive due to advantages such as a high quality picture, small size, low power consumption and relatively low cost manufacture. The conventional active matrix liquid crystal display includes a plurality of cells which are arranged in matrix. The active matrix liquid crystal display includes a plurality of columns of data lines and a plurality of rows of gate lines, both of which form the matrix.

FIG. 1 illustrates the structure of each matrix cell of the active matrix liquid crystal display. Each matrix cell of the liquid crystal display comprises gate lines 1, source lines 2 serving as data lines, a capacitor comprising a pixel electrode 3 and an opposite electrode and a thin film field effect transistor 4. The gate line 1 and the source line 2 are made of a metal such as chrome or aluminium. The pixel electrode 3 and the opposite electrode are formed on one substrate and on an opposite substrate respectively. The pixel electrode 3 of the capacitor is made of a transparent metal such as indium oxide or tin oxide. The thin film field effect transistor 4 is formed by using amorphous silicon.

FIG. 2 illustrates an equivalent circuit of each matrix cell of the active matrix liquid crystal display illustrated in FIG. 1. The circuit structure of each matrix includes columns of the source lines 2 serving as data lines and rows of the gate lines 1, both of which are crossed with each other at right angle but not contact with each other. The thin film field effect transistor 4 is connected at its gate to the gate line 1. The thin film field effect transistor 4 is also connected at its source to the source line 2. The thin film field effect transistor 4 is also connected at its drain to the pixel electrode 3 of a capacitor 5. The capacitor 5 comprises a liquid crystal cell. The liquid crystal cell capacitor 5 comprises the pixel electrode 3 and an opposite electrode COM.

The control voltage signals of the scanning pulses are transmitted through a gate line Gn of the gate lines 1 and applied to the gate of the thin film field effect transistor 4. The thin film field effect transistor 4 serves as a switching device being operated depending upon the control voltage signals of the scanning pulses transmitted through the gate line Gn. The image signals as image data are transmitted through the source lines $S_m$ and $S_{m+1}$ serving as the data lines 2. When the thin film field effect transistor 4 takes ON state, the image signals as the image data are transmitted through the thin film field effect transistor 4 to the pixel electrode 3 of the liquid crystal capacitor 5. Thus, the image signals are applied to the pixel electrode 3 of the liquid crystal capacitor 5. After that, the thin film field effect transistor 4 turns OFF according to the control voltage signals of the scanning pulses thereby maintaining the voltage as the image signal applied to the pixel electrode 3 of the liquid crystal capacitor 5 constant. Thus, the liquid crystal capacitor 5 of the matrix cell serves as a memory cell which stores the image signal. The gray level of each pixel of the active matrix liquid crystal display is dependent upon the voltage level applied to the pixel electrode 3 of the liquid crystal capacitor 5 of the each matrix cell.

The achievement of an excellent picture on the active matrix liquid crystal display requires each liquid crystal capacitor cell 5 to have stability in its potential during the OFF state of the thin film field effect transistor 4. Namely, it is required to keep the voltage signal as the. image data stored in the pixel capacitor 3 from being varied during the OFF state of the thin film field effect transistor 4.

On the other hand, such active matrix liquid crystal display is required to have a high integration. The improvement of the high integration of the active matrix liquid crystal display is coupled with a disadvantage in crosstalk. In FIGS. 1 and 2, the achievement of the high integration of the active matrix liquid crystal display forces the distance between the pixel electrode 3 and the data lines 2, or the source lines $S_m$ and $S_{m+1}$, to be small. This forms capacitive coupling, and thus the parasitic capacitance $C_{sp1}$ and $C_{sp2}$ between the pixel electrode 3 and the data lines 2 or the source lines $S_m$ and $S_{m+1}$. Thus, the equivalent circuit illustrated in FIG. 2 includes parasitic capacitors 6 having parasitic capacitance $C_{sp1}$ and $C_{sp2}$. The parasitic capacitor 6 having the parasitic capacitance $C_{sp1}$ is formed between the source line $S_m$ and the pixel electrode of the liquid crystal cell capacitor 5 having a capacitance $C_{LC}$. The parasitic capacitor 6 having the parasitic capacitance $C_{sp2}$ is formed between the source line $S_{m+1}$ and the pixel electrode of the liquid crystal cell capacitor 5.

When the image signals are applied on the data lines 2, or the source lines $S_m$ and $S_{m+1}$, the pixel capacitor S between the data lines 2 of the liquid crystal cell capacitor 5 are subjected to change of their potential. The voltage applied on the data lines 2 provides an undesirable effect in parallel to the pixel electrode 3 of the liquid crystal cell capacitor 5. This causes the crosstalk of the pixel electrode 3 of the liquid crystal cell capacitor 5. The potential $V_{LC}$ of the pixel electrode 3 of the liquid crystal capacitor cell 5 is varied in dependence upon the parasitic capacitance $C_{sp1}$ and $C_{sp2}$ and the variations of the voltages $V_{Sm}$ and $V_{Sm+1}$ of the image signals applied on the source lines $S_m$ and $S_{m+1}$. A variation $\Delta V_{LC1}$ of the potential of the pixel capacitor 3 of the liquid crystal cell capacitor 5 is caused by the voltage signal applied on the source line $S_m$. A variation $\Delta V_{LC2}$ of the potential of the pixel capacitor 3 of the liquid crystal cell capacitor 5 is caused by the voltage signal applied on the source line $S_{m+1}$. The variations $\Delta V_{LC1}$ and $\Delta V_{LC2}$ of the potential of the pixel electrode 3 are respectively given by:

$$\Delta V_{LC1}=\Delta V_{Sm}\times C_{sp1}/(C_{sp1}+C_{sp2}+C_{LC}) \quad (1),$$

and $$\Delta V_{LC2}=\Delta V_{Sm+1}\times C_{sp2}/(C_{sp1}+C_{sp2}+C_{LC}) \quad (2).$$

The potential variation of the pixel electrode 3 of the liquid crystal cell capacitor 5 is defined by the addition of the variations $\Delta V_{LC1}$ and $\Delta V_{LC2}$. If the addition of the variations $\Delta V_{LC1}$ and $\Delta V_{LC2}$ is zero, there exist no potential variation of the pixel electrode 3 and thus no crosstalk in the cell of the active matrix liquid crystal display. If the crosstalk exists in the cell of the active matrix liquid crystal display and thus the addition of the variations $\Delta V_{LC1}$ and $\Delta V_{LC2}$ is not zero, undesirable effects caused by the crosstalk appear on the liquid crystal display in a direction parallel to the column data lines 2.

As described the above, the realization of an excellent picture on the liquid crystal display requires keeping the potential of the pixel electrode 3 constant. If, however, the crosstalk appears at the pixel electrode 3 of the liquid crystal cell capacitor 5, it is no longer possible to realize an excellent picture on the liquid crystal display.

To combat the above disadvantage in the crosstalk, the conventional active matrix display has so driven the data lines 2 that the voltage signals regarded as the image signals having different polarities from one another are applied on adjacent two data lines, or the adjacent source lines $S_m$ and $S_{m+1}$. Namely, the alternation of the image voltage signals data line by data line are applied. As a result, the potential variations $\Delta V_{LC1}$ and $\Delta V_{LC2}$ of of the pixel electrode 3 have opposite signs relative to one another thereby resulting in a small value of the addition of the potential variations $\Delta V_{LC1}$ and $\Delta V_{LC2}$, and thus a small potential variation of the pixel electrode 3.

To eliminate the above disadvantage in the crosstalk, the conventional driving operation of the data lines 2 in the active matrix liquid crystal display will be described. FIG. 3 illustrates wave-forms of the control voltage signals applied on the gate lines 1 and the image voltage signals applied on the data lines 2. In FIG. 3, $V_{Gn}$ is a wave-form of the control voltage signal as the scanning pulse applied on the gate line $G_n$. $V_{Gn+1}$ is a wave-form of the control voltage signal as the scanning pulse applied on the gate line $G_{n+1}$. $V_{COM}$ are wave-forms of the voltages applied to the opposite electrodes of the liquid crystal cell capacitors 5. $V_{Sm}$ is a wave-form of the image voltage signal applied on the source line $S_m$. $V_{Sm+1}$ is a wave-form of the image voltage signal applied on the source line $S_{m+1}$. T is the period of the image voltage signal for each pixel. The image voltage signals $V_{Sm}$ and $V_{Sm+1}$ have wave-forms of alternating voltage pulses, thereby resulting in the alternating driving of the liquid crystal cell. This secures long life time of the liquid crystal display. The polarity of each of the image voltage signals $V_{Sm}$ and $V_{Sm+1}$ is inverted on every ON signals of the scanning pulses $V_{Gn}$ and $V_{Gn+1}$ applied on the gate lines $G_n$ and $G_{n+1}$. On each period T of the image voltage signal for each pixel, the polarities of the image voltage signals $V_{Sm}$ and $V_{Sm+1}$ are inverted relative to one another.

Actually, however, the image voltage signals $V_{Sm}$ and $V_{Sm+1}$ have asymmetry relative to each other. In this case, the addition of both the potential variation values of the pixel capacitor 3 caused by the image voltage signals $V_{Sm}$ and $V_{Sm+1}$ applied on the source lines $S_m$ and $S_{m+1}$ is not zero. Thus the pixel electrode 3 of the liquid crystal cell capacitor 5 has a potential variation caused by crosstalk.

One of techniques for compensation of the crosstalk is disclosed in IEEE, 1988, 1988 International Display Research Conference, "Eliminating Crosstalk in Thin Film Transistor/Liquid Crystal Displays", pp. 230–235. The conventional technique for compensation of crosstalk employs addressing each display cell for a half time interval T/2 of the interval T required to address each cell of the active matrix liquid crystal display as described the above. FIG. 4 illustrates wave-forms of the gate control voltage of the scanning pulses $V_{Gi}$, $V_{Gi+1}$ and $V_{Gi+2}$ and the image voltage signal $V_{DATA}$ as image data.

In FIG. 4, the high voltage signal making the switching transistor take the ON state is applied on the gate lines for the first half of the time period T which was required in the prior art to address each cell of the active matrix liquid crystal display. Then, the transistor serving as a switching device takes ON state for the first half interval T/2. As a result, each of the image data voltage signals having values $V_i$, $V_{i+1}$ and $V_{i+2}$ is transmitted through the transistor 4 to the pixel capacitor 3 of the liquid crystal cell capacitor 5.

After that, the low voltage signal making the switching transistor the OFF state is applied on the gate lines for the latter half of the time period T which was required in the prior art to address each cell of the active matrix liquid crystal display. Then, the transistor serving as a switching device takes OFF state for the latter half interval T/2. As a result, each of data complement voltages $V_M-V_i$, $V_M-V_{i+1}$ and $V_M-V_{i+2}$ are applied on the data lines, but not transmitted through the transistor 4 to the pixel capacitor 3 of the liquid crystal cell capacitor 5. The values $V_M-V_i$, $V_M-V_{i+1}$ and $V_M-V_{i+2}$ of the voltage signals are defined by subtracting the image data voltage values $V_i$, $V_{i+1}$ and $V_{i+2}$ from a predetermined constant value, for example, a maximum value $V_M$. The time average of the image data voltage signal and the data complement voltage signal is the same on its absolute value in every time intervals T. The absolute values of the averages of the voltage signals, both of which are applied on adjacent data lines, are the same one another. The symmetry of the voltage signals synchronizing with one another and being applied on the adjacent data lines is improved, however not completely.

One example of the monotone displays is illustrated in FIG. 5. FIG. 6 illustrates wave-forms of the gate control voltages of the scanning pulses $V_{G1}$, $V_{G2}$, $V_{G3}$ and $V_{G4}$ and the image data voltage signals $V_{D0}$, $V_{D1}$ and $V_{D2}$, in addition the crosstalks of the matrix cells (0,0) and (0,1). In this case, the monotone display will be accomplished. The image data voltage signals applied on the data lines $V_{D0}$ and $V_{D1}$ are symmetrical. Then, the cell capacitor (0,0) having the parasitic couplings with the data lines $D_0$ and $D_1$ suffers no affect in the crosstalk. In contrast, the image data voltage signals applied on the data lines $V_{D1}$ and $V_{D2}$ are asymmetrical. Then, the cell capacitor (1,0) having the parasitic couplings with the data lines $D_1$ and $D_2$ suffers an affect in the crosstalk as illustrated in FIG. 6. The crosstalk appears in the second and fourth intervals. Namely, in the second and fourth time interval T, such crosstalk appears for not only the first half interval, in which the image data voltage signal is applied, but also the latter half interval, in which the data complement voltage is applied.

In the above conventional technique using the data complement voltage, when the gray levels for adjacent cells respectively connected to the adjacent data lines are different from one another, neither the image data voltage signals applied for the first half interval nor the data complement voltage signals applied for latter half interval is symmetrical. Thus, such driving method is unable to cancel the potential variations of the cell capacitor (1,0), both of which are caused by the asymmetrical voltage signals applied on the data lines $D_1$ and $D_2$ respectively, thereby permitting the crosstalk to appear every column-aligned cells between the data lines $D_1$ and $D_2$. Then, the liquid crystal display of the active matrix has the undesirable picture affect caused by the crosstalk in a direction parallel to the column data lines. Therefore, the conventional technique using the data complement signals unables to compensate for crosstalk completely.

The realization of an excellent and fine picture on liquid crystal displays requires such undesirable crosstalk to be reduced considerably. It is, thus, required to develop a novel driving method of the data lines involved in the active matrix liquid crystal display thereby making the display free from crosstalk.

SUMMARY OF THE INVENTION

Accordingly, it is a primary object of the present invention to provide a novel method of driving an active matrix liquid crystal display accomplishing fine and excellent pictures.

It is a further object of the present invention to provide a novel method of driving data lines to be applied with image data voltage signals involved in an active matrix liquid crystal display, which permits keeping crosstalk from appearing on a column alignment of capacitor cells.

The above and other objects, features and advantages of the present invention will be apparent from the following descriptions.

The present invention provides a novel method of driving an active matrix liquid crystal display device in which alternating pulse voltage signals synchronizing with gate control pulse voltage signals are applied on data lines. Predetermined positive and negative constant voltages are applied on data lines in an initial time interval. The constant voltage to be applied on adjacent two lines have opposite polarities relative to one another. The constant voltage is independent of image data. Subsequently, voltage signals as image data are applied on the data lines in a later time interval. Each of the voltage signals as image data has a voltage level corresponding to a gray level of a pixel in the display. The each voltage signal has the same polarity as the constant voltage. A pair of the first and second application steps are continued.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

Preferred embodiments of the-present invention provide novel methods of driving an active matrix liquid crystal display with 640×400 pixels and a pixel pitch of 0.33 mm which are used for personal computers.

A first embodiment of the present invention will be described with reference to FIGS. 7, 8 and 9.

Figure 7:
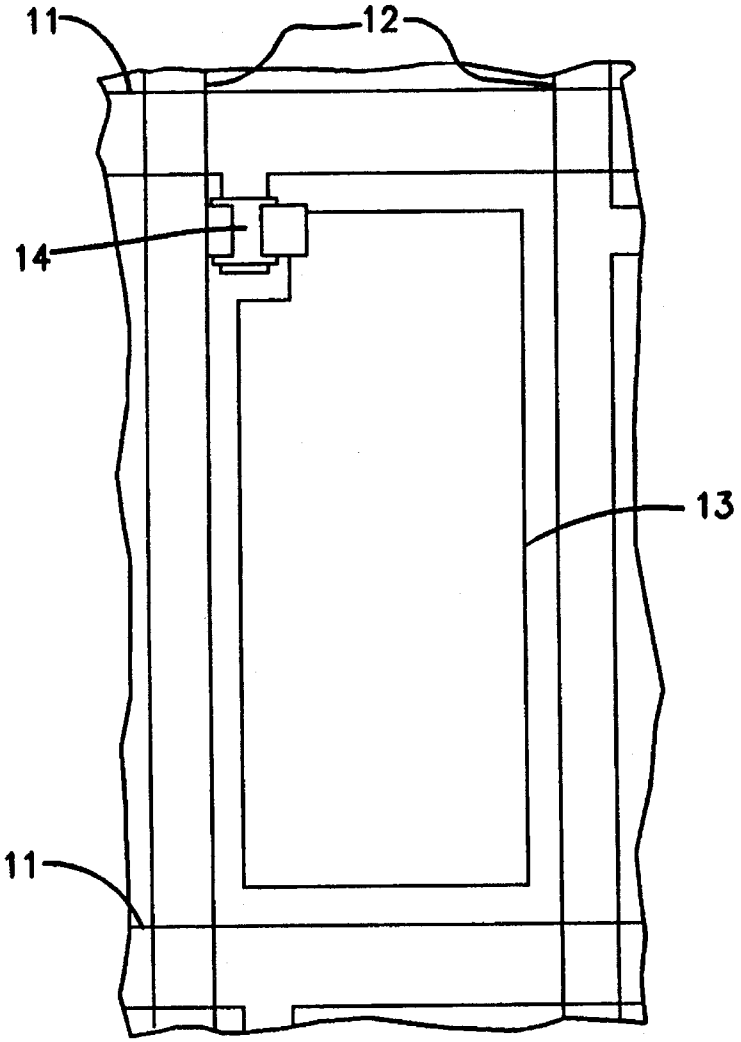
FIG. 7 is a fragmentary cross sectional elevation view illustrative of the structure of each matrix cell involved in an active matrix liquid crystal display according to the present invention.
Figure 9A:
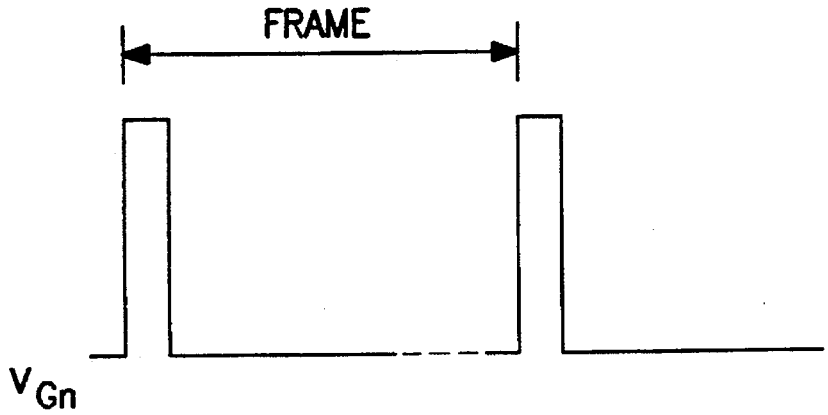
FIG. 9 is a view illustrative of wave-forms of gate control voltage signals of scanning pulses to be applied on row gate lines and image data voltage signals to be applied on column data lines in a first embodiment according to the present invention.
Figure 9B:
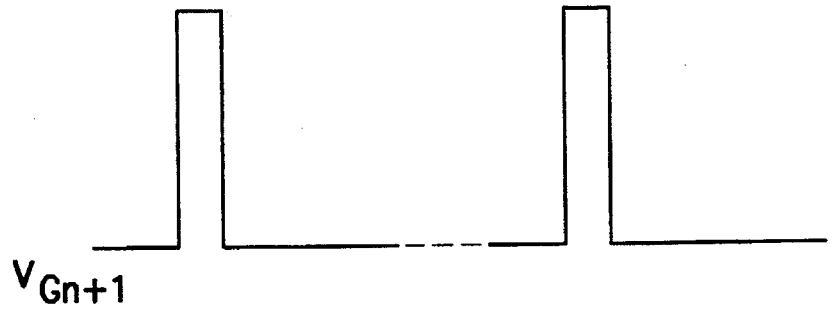
Figure 9C:
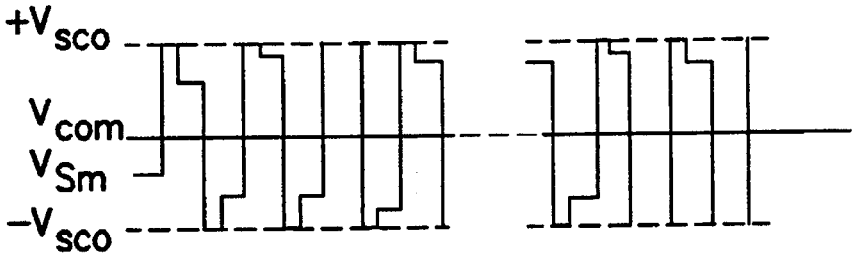
Figure 9D:
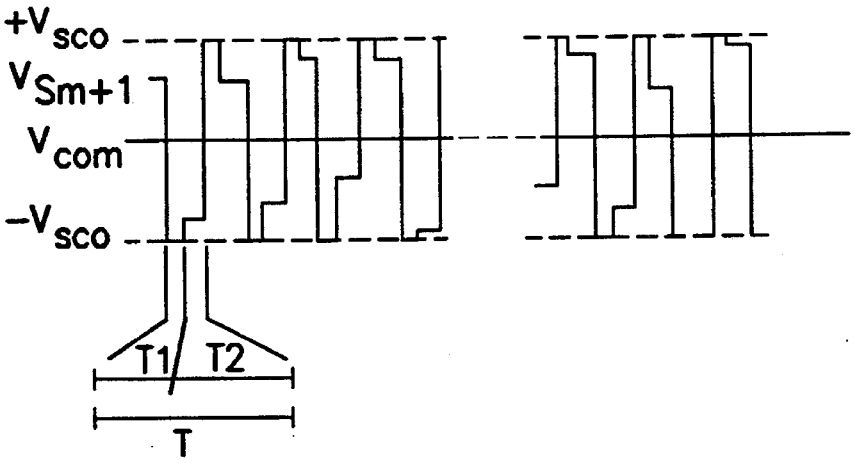
Figure 10A:
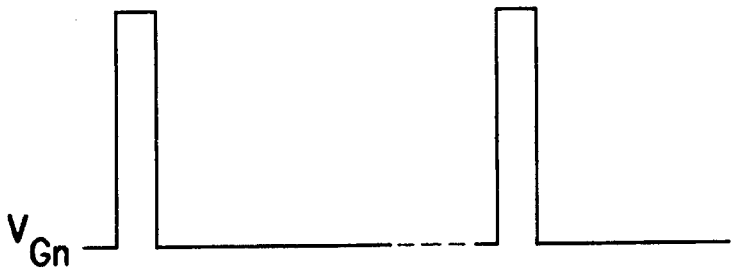
FIGS. 10A–10D are views illustrative of wave-forms of gate control voltage signals of scanning pulses to be applied on row gate lines and image data voltage signals to be applied on column data lines in a second embodiment according to the present invention.
Figure 10B:
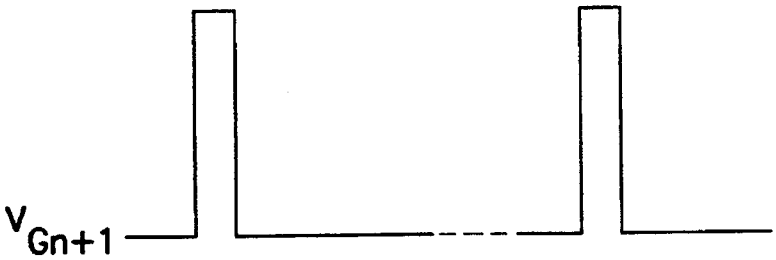
Figure 10C:
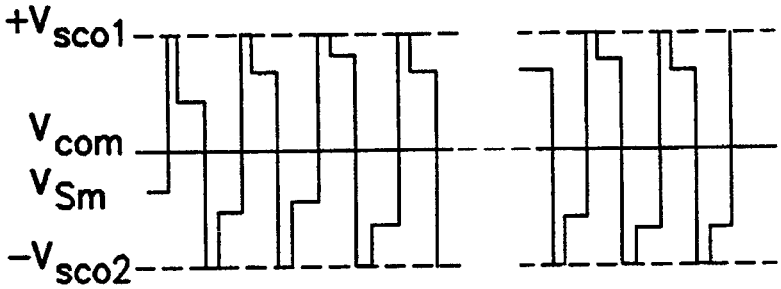
Figure 10D:
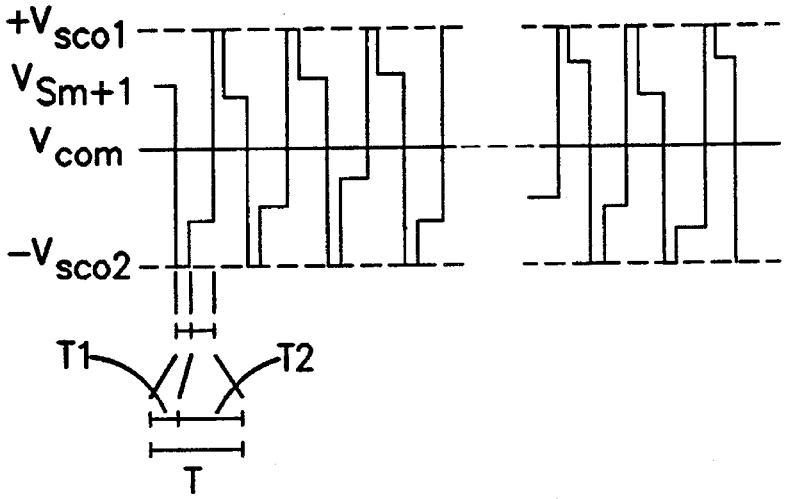
Figure 11A:
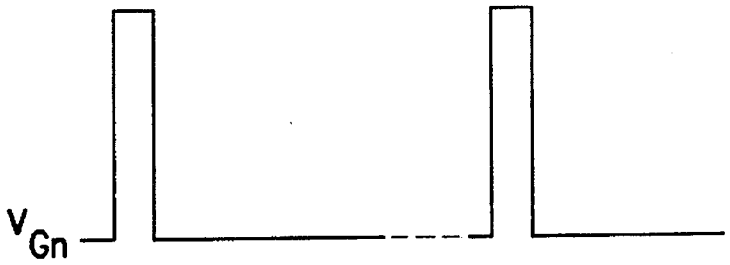
FIGS. 11A–11D are views illustrative of wave-forms of gate control voltage signals of scanning pulses to be applied on row gate lines and image data voltage signals to be applied on column data lines in a third embodiment according to the present invention.
Figure 11B:
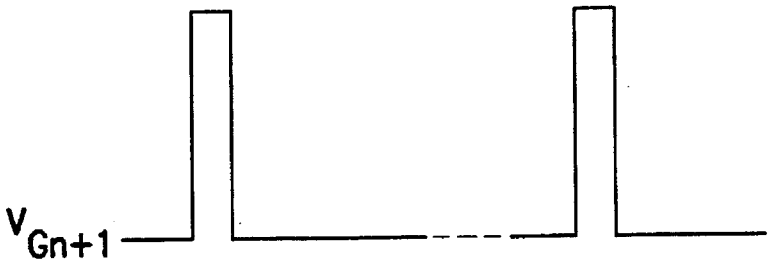
Figure 11C:
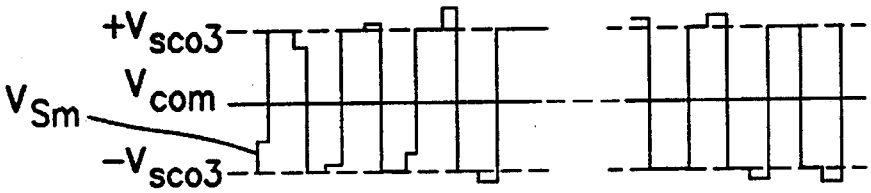
Figure 11D:
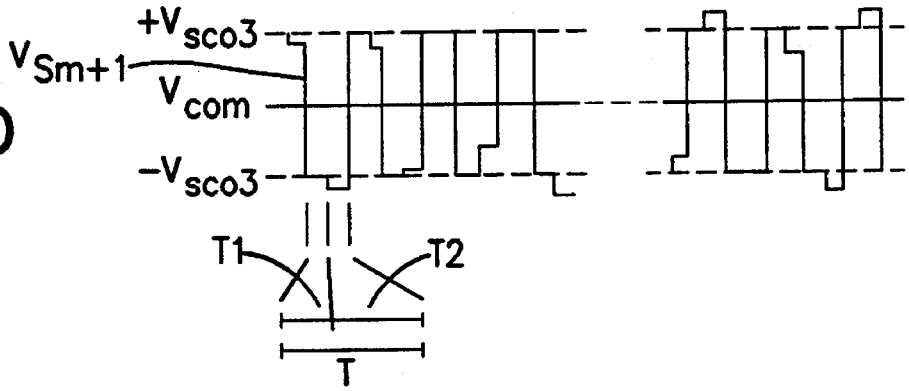

FIG. 7 illustrates the structure of each matrix cell of the active matrix liquid crystal display according to the present invention. The active matrix liquid crystal display according to the present invention has the same structure as comprises, in FIG. 8, gate lines 11, source lines $S_m$ and $S_{m+1}$ serving as the prior art. Each matrix cell of the liquid crystal display data lines 12, a capacitor comprising a pixel electrode 13 and an opposite electrode and a thin film field effect transistor 14. The gate line 11 and the source line 12 are made of a metal such as chrome or aluminium. The pixel electrode 13 and the opposite electrode are formed on one substrate and on an opposite substrate respectively. The pixel electrode 13 of the capacitor is made of a transparent metal such as indium oxide or tin oxide. The thin film field effect transistor 14 is formed by using amorphous silicon or polycrystalline silicon.

Figure 8:
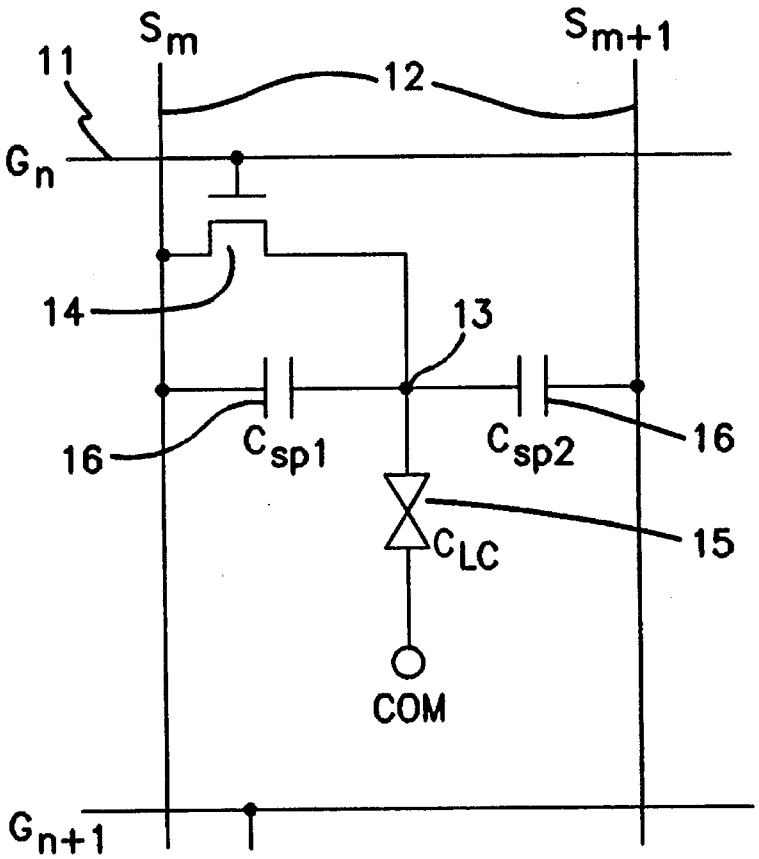
FIG. 8 is a circuit diagram illustrative of the equivalent circuit of the active matrix cell illustrated in FIG. 7.

FIG. 8 illustrates an equivalent circuit of each matrix cell of the active matrix liquid crystal display illustrated in FIG. 7. The circuit structure of each matrix includes columns of the source lines $S_m$ and $S_{m+1}$ serving as data lines 12 and rows of the gate lines 11 ($G_n$ and $G_{n+1}$), both of which are crossed with each other at right angle but not in contact with each other. The thin film field effect transistor 14 is connected at its gate to the gate line 11. The thin film field effect transistor 14 is also connected at its source to the source line 12. The thin film field effect transistor 14 is also connected at its drain to the pixel electrode 13 of a capacitor 15. The capacitor 15 comprises a liquid crystal cell. The liquid crystal cell capacitor 15 comprises the pixel electrode 13 and an opposite electrode COM.

The gate control voltage signal of the scanning pulses is transmitted through a gate line $G_n$ and applied to the gate of the thin film field effect transistor 14. The thin film field effect transistor 14 serves as a switching device being operated depending upon the gate control voltage signals of the scanning pulses transmitted through the gate line $G_n$. The image data voltage signals as image data are transmitted through the source lines $S_m$ and $S_{m+1}$ serving as the data lines 12. When the thin film field effect transistor 14 takes ON state, the image signal as the image data is transmitted through the thin film field effect transistor 14 to the pixel electrode 13 of the liquid crystal capacitor 15. Thus, the image signal is applied to the pixel electrode 13 of the liquid crystal capacitor 15. After that, the thin film field effect transistor 14 turns OFF according to the gate control voltage signals of the scanning pulses thereby maintaining the voltage as the image data voltage signal applied to the pixel electrode 13 of the liquid crystal capacitor 15 constant. Thus, the liquid crystal capacitor 15 of the matrix cell serves as a memory cell which stores the image signal. The gray level of each pixel of the active matrix liquid crystal display depends upon the voltage level applied to the pixel electrode 13 of the liquid crystal capacitor 15 of the each matrix cell.

In FIGS. 7 and 8, the achievement of high integration of the active matrix liquid crystal display forces the distance between the pixel electrode 13 and the data lines 12 or the source lines $S_m$ and $S_{m+1}$ to be small. This forms capacitive coupling, and thus the parasitic capacitance $C_{sp1}$ and $C_{sp2}$ between the the pixel electrode 13 and the data lines 12 or the source lines $S_m$ and $S_{m+1}$. Thus, the equivalent circuit illustrated in FIG. 8 includes parasitic capacitors 16 having parasitic capacitance $C_{sp1}$ and $C_{sp2}$. The parasitic capacitor 16 having the parasitic capacitance $C_{sp1}$ is formed between the source line $S_m$ and the pixel electrode of the liquid crystal cell capacitor 15 having a capacitance $C_{LC}$. The parasitic capacitor 16 having the parasitic capacitance $C_{sp2}$ is formed between the source line $S_{m+1}$ and the pixel electrode of the liquid crystal cell capacitor 15.

A novel driving operation of the data lines 12 in the active matrix liquid crystal display will now be described. FIG. 9 illustrates wave-forms of the control voltage signals to be applied on the gate lines 11 and the image voltage signals to be applied on the data lines 12. In FIG. 9, $V_{Gn}$ is a wave-form of the gate control voltage signal as the scanning pulse to be applied on the gate line $G_n$. $V_{Gn+1}$ is a wave-form of the gate control voltage signal as the scanning pulse to be applied on the gate line $G_{n+1}$. $V_{COM}$ are wave-forms of the voltages to be applied to the opposite electrodes of the liquid crystal cell capacitors 15. $+V_{sco}$ and $-V_{sco}$ are respectively positive and negative constant voltages which have the same absolute value. Further, the positive and negative constant voltage values $+V_{sco}$ and $-V_{sco}$ define the maximum absolute value of the image data voltage signals to be applied on the data lines. Namely, the positive and negative constant voltage values $+V_{sco}$ and $-V_{sco}$ are respectively so determined as to be equal to the maximum absolute value of the image data voltage signals to be applied on the data lines. $V_{Sm}$ is a wave-form of the image data voltage signal to be applied on the source line $S_m$. $V_{Sm+1}$ is a wave-form of the image data voltage signal to be applied on the source line $S_{m+1}$. T is a time interval in which the image data voltage signal for each matrix cell or a pixel is applied on the source lines. Further, the time interval T for a single cell addressing are divided into two time intervals, an initial time interval T1 and a latter time interval T2. Thus, the addition of time intervals T1 and T2 is equal to the time interval T. For example, the time interval T is 40 microseconds. The initial and latter time intervals T1 and T2 are 15 microseconds, respectively and 25 microseconds. The above values of the time intervals T, T1 and T2 are variable but on condition that the addition of the initial and latter tine intervals T1 and T2 are equal to the time interval T.

Each of the image data voltage signals $V_{Sm}$ and $V_{Sm+1}$ has a wave-form of alternating voltage pulses, thereby resulting in the alternating driving of the liquid crystal cell. This secures long life time of the liquid crystal display. The polarity of each of the image data voltage signals $V_{Sm}$ and $V_{Sm+1}$ is inverted on every ON signal of the scanning pulses $V_{Gn}$ and $V_{Gn+1}$ applied on the gate lines $G_n$ and $G_{n+1}$. Namely, the image data voltage signal for a frame is inverted relative to the image data voltage signal for next frame.

Further, the image data voltage signals synchronizing with one another and being applied on the adjacent source lines $S_m$ and $S_{m+1}$ have opposite polarities to one another as illustrated in FIG. 9. Namely, the alternation of the image data voltage signals, source line by source line, are applied.

In every initial time intervals T1, each of the image data voltage signals takes the positive or negative constant voltage value $+V_{sco}$ or $-V_{sco}$. In every latter time intervals T2, each of the image data voltage signals takes a voltage level corresponding to the image data which determines the gray level of a pixel in the active matrix liquid crystal display. A single frame is defined by a time interval between a pulse and a next pulse of the gate control voltage.

The operation of the active matrix liquid crystal display will be described with reference to FIGS. 8 and 9.

For a first time interval T in one frame, the gate control voltage $V_{Gn}$ applied on the gate line $G_n$ takes a high digit value. The thin film field effect transistor 14 turns ON. The gate control voltage $V_{Gn}$ remains at the high digit value for the time interval T, in which addressing for the cell capacitor 15 is accomplished. For the time interval T, the liquid crystal cell capacitor 15 serving as a memory cell takes a write-enable state.

With respect to the source line $S_m$, the image data voltage signal $V_{Sm}$ of the alternating voltage pulse is applied on the source line $S_m$. In the initial time interval T1 divided from the first time interval T of the frame, the positive constant voltage $+V_{sco}$ is applied on the source line $S_m$, after which the positive constant voltage $+V_{sco}$ is transmitted through the thin film field effect transistor 14 to the pixel electrode 13 of the liquid crystal cell capacitor 15 having a capacitance $C_{LC}$. The positive constant voltage $+V_{sco}$ applied to the liquid crystal cell capacitor 15 has no image data. In the latter time interval T2 divided from the first time interval T of the frame, a positive voltage level as the image data corresponding to a gray level of a pixel involved in the display is applied on the source line $S_m$. The positive image data voltage signal is transmitted through the thin film field effect transistor 14 to the pixel electrode 13 of the liquid crystal cell capacitor 15. As a result, the pixel electrode 13 takes the image data voltage level which makes the pixel show a required gray level. After the latter time interval T2 divided from the first time interval T of the frame, the gate control voltage signal which has been applied on the gate line $G_n$ becomes a low value. Then, the thin film field effect transistor 14 takes the OFF state. Then, the liquid crystal cell capacitor 15 stores and maintains the image data voltage signal until a next ON state of the thin film field effect transistor 14, thereby keeping the pixel electrode 13 at the image data voltage level for one frame. The absolute value of the image data voltage level determines the gray level of the pixel. Namely, the polarity of the image data voltage level is independent of the gray level of the pixel.

In contrast, in the first time interval T of the frame, the gate control voltage $V_{Gn+1}$ applied on the gate line $G_{n+1}$ takes a low digit value. Then, an adjacent thin film field effect transistor takes OFF state. The gate control voltage $V_{Gn+1}$ remains at the low digit value for the first time interval T in one frame. For the first time interval T in one frame, an adjacent liquid crystal cell capacitor serving as a memory cell takes a write-unable state.

With respect to the source line $S_{m+1}$, the image data voltage signal $V_{Sm+1}$ of the alternating voltage pulse being to be applied on the source line $S_{m+1}$ synchronizes but at inverse polarity with the image data voltage signal $V_S$ applied on the source line $S_m$. In the initial time interval T1 divided from the first time interval T of the frame, the negative constant voltage $-V_{sco}$ is applied on the source line $S_{m+1}$ but not applied to the adjacent liquid crystal cell capacitor. In the latter time interval T2 divided from the first time interval T of the frame, the negative image data voltage signal is also applied on the source line $S_{m+1}$ but not applied to the adjacent liquid crystal cell capacitor.

The liquid crystal cell capacitor 15 has a response speed of several ten milliseconds which is much longer than a single scanning time of several ten microseconds. This makes it impossible that a gray level corresponding to the positive constant voltage level $+V_{sco}$ appears on the pixel. A single frame comprises a much longer time than the response speed of the liquid crystal. For a single frame, the liquid crystal cell capacitor keeps the image data voltage level constant. This permits a gray level corresponding to the positive image data voltage level to appear on the pixel.

For a second time interval T in the frame, the gate control voltage $V_{Gn}$ applied on the gate line $G_n$ takes a low digit value. Thus, the thin film field effect transistor 14 takes OFF state. The gate control voltage $V_G$ remains at the low digit value for the second time interval T of the frame. For the second time interval T of the frame, the liquid crystal cell capacitor 15 serving as a memory cell takes a write-unable state.

With respect to the source line $S_m$, the image data voltage signal $V_{Sm}$ of the alternating voltage pulse is applied on the source line $S_m$. In the initial time interval T1 divided from the second time interval T of the frame, the negative constant voltage $-V_{sco}$ is applied on the source line $S_m$ but not applied to the adjacent liquid crystal cell capacitor. In the latter time interval T2 divided from the second time interval T of the frame, the negative constant voltage $-V_{sco}$ is applied on the source line $S_m$ but not applied to the liquid crystal cell capacitor 15.

In contrast, in the second time interval T of the frame, the gate control voltage $V_{Gn+1}$ applied on the gate line $G_{n+1}$ takes a high digit value. The adjacent thin film field effect transistor turns ON. The gate control voltage $V_{Gn+1}$ remains at the high digit value for the second time interval T of the frame, in which the addressing for the adjacent cell capacitor is accomplished. For the second time interval T of the frame, the adjacent liquid crystal cell capacitor serving as a memory cell takes a write-enable state.

With respect to the source line $S_{m+1}$, the image data voltage signal $V_{Sm+1}$ of the alternating voltage pulse applied on the source line $S_{m+1}$ synchronizes with the image data voltage signal $V_S$ applied on the source line $S_m$, but at inverse polarity. In the initial time interval T1 divided from the second time interval T of the frame, the positive constant voltage $+V_{sco}$ is applied on the source line $S_{m+1}$, after which the positive constant voltage $+V_{sco}$ is transmitted through the adjacent thin film field effect transistor to the pixel electrode of the adjacent liquid crystal cell capacitor. The positive constant voltage $+V_{sco}$ applied to the adjacent liquid crystal cell capacitor has no image data. In the latter time interval T2 divided from the second time interval T of the frame, a positive voltage level as the image data corresponding to a gray level of an adjacent pixel involved in the display is applied on the source line $S_{m+1}$. The positive image data voltage signal is transmitted through the adjacent thin film field effect transistor to the pixel electrode of the adjacent liquid crystal cell capacitor. As a result, the adjacent pixel electrode takes the image data voltage level which makes the pixel show a required gray level. After the latter time interval T2 divided from the second time interval T of the frame, the gate control voltage signal which has been applied on the gate line $G_{n+1}$ takes a low value. Then, the adjacent thin film field effect transistor takes the OFF state. Then, the adjacent liquid crystal cell capacitor stores and maintains the image data voltage signal until a next ON state of the thin film field effect transistor, thereby keeping the pixel electrode at the image data voltage level for one frame.

Subsequently, the applications of such alternating pulse wave-forms $V_{Sm}$ and $V_{Sm+1}$ on the source lines $S_m$ and $S_{m+1}$ are continuously accomplished. After one frame, the gate control voltage signal $V_{Gn}$ takes the high value which makes the thin film field effect transistor 14 take ON state. The negative image data voltage signal $V_{Sm}$ is applied on the source line $S_m$, and then transmitted to the liquid crystal cell capacitor 15. Such driving method is so accomplished as to make the polarity of the liquid crystal capacitor alternate from positive to negative or from negative to positive. Thus, the liquid crystal cell capacitor 15 performs alternating driving, frame by frame.

The quantity of the crosstalk appearing on the pixel electrode 3 of the liquid crystal cell capacitor 15 will now be investigated. As described above, the potential variations $\Delta V_{LC1}$ and $\Delta V_{LC2}$ of the pixel electrode 3 of the liquid crystal cell capacitor 15 caused by the image data voltage signals applied on the source lines $S_m$ and $S_{m+1}$ are respectively given by the equations (1) and (2).

$$\Delta V_{LC1}=\Delta V_{Sm}\times C_{sp1}/(C_{sp1}+C_{sp2}+C_{LC}) \quad (1)$$

$$\Delta V_{LC2}=\Delta V_{Sm+1}\times C_{sp2}/(C_{sp1}+C_{sp2}+C_{LC}) \quad (2)$$

In the initial time interval T1 divided from each of the time intervals T of the frame, the source lines $S_m$ and $S_{m+1}$ are respectively applied with the constant voltage signals. The potential variations $\Delta V_{Sm}$ and $\Delta V_{Sm+1}$ of the pixel electrode 13 of the liquid crystal cell capacitor 15 are respectively given by:

$$\begin{aligned}\Delta V_{Sm} &= V_{sco}-(-V_{sco})\\ &= 2V_{sco}, \text{ and}\\ \Delta V_{Sm+1} &= (-V_{sco})-V_{sco}\\ &= -2V_{sco}.\end{aligned}$$

Then, the potential variation of the pixel electrode 13 of the liquid crystal cell capacitor 15 are given by addition of $\Delta V_{LC1}$ and $\Delta V_{LC2}$. Then, the potential variation is approximately zero. Thus, the potential variations $\Delta V_{LC1}$ and $\Delta V_{LC2}$ are cancel one another, thereby resulting in zero crosstalk but only in the every initial time intervals T1.

In the latter time interval T2 divided from each of the time intervals T, the potential variations $\Delta V_{Sm}$ and $\Delta V_{Sm+1}$ of the pixel electrode 3 of the liquid crystal cell capacitor 15 cancel one another, but not completely, since the image data voltage levels are asymmetrical with respect to one another. The potential variation of the pixel electrode 3 of the liquid crystal cell capacitor 15 are, however, reduced considerably, because the potential variation of the pixel electrode 3 occurs only in the latter time intervals T2 in which the asymmetrical image data voltage signals are applied on the source lines $S_m$ and $S_{m+1}$. Thus, the average between one frame of the potential variation of the pixel electrode 13 of the liquid crystal cell capacitor 15 are also reduced considerably due to no potential variation of the pixel capacitor 13 in the initial time intervals T1.

Such considerable reduction of the potential variation in the average for one frame keeps crosstalk from appearing at the liquid crystal cell capacitor 15, thereby realizing an excellent and fine picture of the active matrix liquid crystal display.

Actually, the active matrix liquid crystal display of the first embodiment according to the present invention is so designed that the distance between the source lines 2 and the pixel electrode 13 of the liquid crystal cell capacitor 15 is approximately 10 micrometers or less. The novel driving method is so accomplished that no crosstalk occurs on the screen of the active matrix cells of the liquid crystal display so designed, although in the prior art considerable crosstalk occurs on the display. Further, the novel driving method is able to suppress the crosstalk to appear on a high integrated active matrix liquid crystal display in which the source lines 2 and the pixel electrode 13 of the liquid crystal display 15 are 5 micrometers. Then, the novel driving method permits such high integrated active matrix liquid crystal display to exhibit an excellent and fine picture.

As modifications of the first embodiment according to the present invention, the initial time intervals T1 and the latter time intervals T2 divided from every time intervals T within the frame are variable, although in the above first embodiment of the present invention the initial and latter time intervals T1 and T2 are 15 microseconds and 25 microseconds respectively. It is possible that the initial and latter time intervals T1 and T2 could be equal to one another. It is also possible that the initial time intervals T1 could be longer than the latter time intervals T2. Eventually, the initial and latter time intervals T1 and T2, both of which are divided from the time intervals T of the frame, are variable by matching the liquid crystal condition, provided that the initial time intervals T1 in which the constant voltages are applied on the source lines 2 are much shorter than the response speed of the liquid crystal involved in the cell capacitor 15 so that the constant voltage signal does not appear on the liquid crystal display.

A second embodiment of the present invention will be described with reference to FIGS. 8 and 10.

A novel driving method of the second embodiment according to the present invention is basically analogous to that of the first embodiment, except for wave-forms of the image data voltage signals. The wave-forms of the image data voltage signals being to be applied on the source lines $S_m$ and $S_{m+1}$ are illustrated in FIG. 10.

In FIG. 10, $V_{Gn}$ is a wave-form of the gate control voltage signal as the scanning pulse to be applied on the gate line $G_n$. $V_{Gn+1}$ is a wave-form of the gate control voltage signal as the scanning pulse to be applied on the gate line $G_{n+1}$. $V_{COM}$ are wave-forms of the voltages to be applied to the opposite electrodes of the liquid crystal cell capacitors 15. The above wave-forms $V_G$, $V_{G+1}$ and $V_{COM}$ are the same as those of the first embodiment. The image data voltage signals have different wave-forms from that of the first embodiment according to the present invention. Namely, $+V_{sco1}$ and $-V_{sco2}$ are respectively positive and negative constant voltages, but are so determined as to have different absolute values from one another. It is possible to so determine the absolute values of the constant voltages that the absolute value of the positive constant voltage $+V_{sco1}$ is either smaller or larger than that of the negative constant voltage $-V_{sco2}$. Further, the positive and negative constant voltage values $+V_{sco1}$ and $-V_{sco2}$ are respectively so determined as to have larger absolute values than the maximum value of the image data voltage signals $V_{Sm}$ and $V_{Sm+1}$. $V_{Sm}$ is a wave-form of the image data voltage signal to be applied on the source line $S_m$. $V_{Sm+1}$ is a wave-form of the image data voltage signal to be applied on the source line $S_{m+1}$. T is a time interval in which the image data voltage signal for each matrix cell or a pixel is applied on the source lines. Further, each of the time interval T in which a single cell addressing is accomplished are divided into two time intervals, an initial time interval T1 and a latter time interval T2. Thus, the addition of both time intervals T1 and T2 are equal to the time interval T. The above values of the time intervals T, T1 and T2 are variable but on condition that the addition of the initial and latter tine intervals T1 and T2 are equal to the time interval T.

Each of the image data voltage signals $V_{Sm}$ and $V_{Sm+1}$ has a wave-form of alternating voltage pulses, thereby resulting in the alternating driving of the liquid crystal cell. This secures long life time of the liquid crystal display. The polarity of each of the image data voltage signals $V_{Sm}$ and $V_{Sm+1}$ is inverted on every ON signals of the scanning pulses $V_{Gn}$ and $V_{Gn+1}$ applied on the gate lines $G_n$ and $G_{n+1}$. Namely, the image data voltage signal for a frame is inverted relative to the image data voltage signal for next frame.

Further, the image data voltage signals synchronizing with one another and being applied on the adjacent source lines $S_m$ and $S_{m+1}$ have opposite polarities relative to one another as illustrated in FIG. 10. Namely, the alternation of the image data voltage signals, source line by source line, is applied.

In every initial time interval T1, each of the image data voltage signals takes the positive or negative constant voltage value $+V_{sco1}$ or $-V_{sco2}$. In every latter time intervals T2, each of the image data voltage signals takes a voltage level corresponding to the image data which determines the gray level of a pixel in the active matrix liquid crystal display. A single frame is defined by a time interval between a pulse and a next pulse of the gate control voltage.

The operation of the active matrix liquid crystal display will be described with reference to FIGS. 8 and 10.

For a first time interval T within one frame, the gate control voltage $V_{Gn}$ applied on the gate line $G_n$ takes a high digit value. The thin film field effect transistor 14 turns ON. The gate control voltage $V_{Gn}$ remains at the high digit value for the time interval T, in which the addressing for the cell capacitor 15 is accomplished. For the time interval T, the liquid crystal cell capacitor 15 serving as a memory cell takes a write-enable state.

With respect to the source line $S_m$, the image data voltage signal $V_{Sm}$ of the alternating voltage pulse is applied on the source line $S_m$. In the initial time interval T1 divided from the first time interval T of the frame, the positive constant voltage $+V_{sco1}$ is applied on the source line $S_m$, after which the positive constant voltage $+V_{sco1}$ is transmitted through the thin film field effect transistor 14 to the pixel electrode 13 of the liquid crystal cell capacitor 15 having the capacitance $C_{LC}$. The positive constant voltage $+V_{sco1}$ applied to the liquid crystal cell capacitor 15 has no image data. In the latter time interval T2 divided from the first time interval T of the frame, a positive voltage level as the image data corresponding to a gray level of a pixel involved in the display is applied on the source line $S_m$. The positive image data voltage signal is transmitted through the thin film field effect transistor 14 to the pixel electrode 13 of the liquid crystal cell capacitor 15. As a result, the pixel electrode 13 takes the image data voltage level which makes the pixel show a required gray level. After the latter time interval T2 divided from the first time interval T of the frame, the gate control voltage signal which has been applied on the gate line $G_n$ becomes a low value. Then, the thin film field effect transistor 14 takes the OFF state. Then, the liquid crystal cell capacitor 15 stores and maintains the image data voltage signal until a next ON state of the thin film field effect transistor 14, thereby keeping the pixel electrode 13 at the image data voltage level for one frame. The absolute value of the image data voltage level determines the gray level of the pixel. Namely, the polarity of the image data voltage level is independent of the gray level of the pixel.

In contrast, in the first time interval T of the frame, the gate control voltage $V_{Gn+1}$ applied on the gate line $G_{n+1}$ takes a low digit value. Then, an adjacent thin film field effect transistor takes the OFF state. The gate control voltage $V_{Gn+1}$ remains at the low digit value for the first time interval T in one frame. For the first time interval T in one frame, an adjacent liquid crystal cell capacitor serving as a memory cell takes a write-unable state.

With respect to the source line $S_{m+1}$, the image data voltage signal $V_{Sm+1}$ of the alternating voltage pulse being applied on the source line $S_{m+1}$ synchronizes but at inverse polarity to the image data voltage signal $V_S$ applied on the source line $S_m$. In the initial time interval T1 divided from the first time interval T of the frame, the negative constant voltage $-V_{sco2}$ is applied on the source line $S_{m+1}$ but not applied to the adjacent liquid crystal cell capacitor. In the latter time interval T2 divided from the first time interval T of the frame, the negative image data voltage signal is also applied on the source line $S_{m+1}$ but not applied to the adjacent liquid crystal cell capacitor.

The liquid crystal cell capacitor 15 has a response speed of several ten milliseconds which is much longer than a single scanning time of several ten microseconds. This makes it impossible that a gray level corresponding to the positive constant voltage level $+V_{sco1}$ could appear on the pixel. A single frame comprises a much longer time than the response speed of the liquid crystal. For a single frame, the liquid crystal cell capacitor keeps the image data voltage level constant. This permits a gray level corresponding to the positive image data voltage level to appear on the pixel.

For a second time interval T in the frame, the gate control voltage $V_{Gn}$ applied on the gate line $G_n$ takes a low digit value. Thus, the thin film field effect transistor 14 takes OFF state. The gate control voltage $V_G$ remains at the low digit value for the second time interval T within the frame. For the second time interval T of the frame, the liquid crystal cell capacitor 15 serving as a memory cell takes a write-unable state.

With respect to the source line $S_m$, the image data voltage signal $V_{Sm}$ of the alternating voltage pulse is applied on the source line $S_m$. In the initial time interval T1 divided from the second time interval T of the frame, the negative constant voltage $-V_{sco2}$ is applied on the source line $S_m$ but not applied to the adjacent liquid crystal cell capacitor. In the latter time interval T2 divided from the second time interval T of the frame, the negative constant voltage $-V_{sco2}$ is applied on the source line $S_m$ but not applied to the liquid crystal cell capacitor 15.

In contrast, in the second time interval T of the frame, the gate control voltage $V_{Gn+1}$ applied on the gate line $G_{n+1}$ takes a high digit value. The adjacent thin film field effect transistor turns ON. The gate control voltage $V_{Gn+1}$ remains at the high digit value for the second time interval T of the frame, in which the addressing for the adjacent cell capacitor is accomplished. For the second time interval T of the frame, the adjacent liquid crystal cell capacitor serving as a memory cell takes a write-enable state.

With respect to the source line $S_{m+1}$, the image data voltage signal $V_{Sm+1}$ of the alternating voltage pulse applied on the source line $S_{m+1}$ synchronizes with the image data voltage signal $V_S$ applied on the source line $S_m$ but at inverse polarity. In the initial time interval T1 divided from the second time interval T of the frame, the positive constant voltage $+V_{sco1}$ is applied on the source line $S_{m+1}$. The positive constant voltage $+V_{sco1}$ applied to the adjacent liquid crystal cell capacitor has no image data. Subsequently, in the latter time interval T2 divided from the second time interval T of the frame, a positive voltage level as the image data corresponding to a gray level of an adjacent pixel involved in the display is applied on the source line $S_{m+1}$. After the latter time interval T2 divided from the second time interval T of the frame, the gate control voltage signal which has been applied on the gate line $G_{n+1}$ takes a low value. Then, the adjacent thin film field effect transistor takes the OFF state. Then, the adjacent liquid crystal cell capacitor stores and maintains the image data voltage signal until a next ON state of the thin film field effect transistor, thereby keeping the pixel electrode at the image data voltage level for one frame.

Subsequently, the applications of such alternating pulse wave-forms $V_{Sm}$ and $V_{Sm+1}$ on the source lines $S_m$ and $S_{m+1}$ are continuously accomplished. After one frame, the gate control voltage signal $V_{Gn}$ takes the high value which makes the thin film field effect transistor 14 take ON state. The negative image data voltage signal $V_{Sm}$ is applied on the source line $S_m$, and then transmitted to the liquid crystal cell capacitor 15. Such driving method is so accomplished as to make the polarity of the liquid crystal capacitor alternate from positive to negative or from negative to positive, frame by frame. Thus, the liquid crystal cell capacitor 15 performs the alternating driving, frame by frame.

The quantity of the crosstalk appearing on the pixel electrode 3 of the liquid crystal cell capacitor 15 will now be investigated. As described above, the potential variations $\Delta V_{LC1}$ and $\Delta V_{LC2}$ of the pixel electrode 13 of the liquid crystal cell capacitor 15 caused by the image data voltage signals applied on the source lines $S_m$ and $S_{m+1}$ are respectively given by the equations (1) and (2).

In the initial time interval T1 divided from each of the time intervals T of the frame, the source lines $S_m$ and $S_{m+1}$ are respectively applied with the constant voltage signals. The potential variations $\Delta V_{Sm}$ and $\Delta V_{Sm+1}$ of the pixel electrode 13 of the liquid crystal cell capacitor 15 are respectively given by:

$$\begin{aligned}\Delta V_{Sm} &= V_{sco1} - (-V_{sco2}) \\ &= V_{sco1} + V_{sco2}, \text{ and} \\ \Delta V_{Sm+1} &= (-V_{sco1}) - V_{sco2} \\ &= -(V_{sco1} + V_{sco2}) \\ &= -V_{Sm}.\end{aligned}$$

Then, the potential variation of the pixel electrode 13 of the liquid crystal cell capacitor 15 is given by addition of $\Delta V_{LC1}$ and $\Delta V_{LC2}$. Then, the potential variation is approximately zero. Thus, the potential variations $\Delta V_{LC1}$ and $\Delta V_{LC2}$ cancel one another thereby resulting in a zero crosstalk but only in the initial time intervals T1.

In the latter time interval T2 divided from each of the time intervals T, the potential variations $\Delta V_{Sm}$ and $\Delta V_{Sm+1}$ of the pixel electrode 13 of the liquid crystal cell capacitor 15 cancel one another but not completely, since the image data voltage levels are asymmetrical relative to one another. The potential variation of the pixel electrode 13 of the liquid crystal cell capacitor 15 is, however, reduced considerably, because the potential variation of the pixel electrode 13 occurs but only in the latter time intervals T2 in which the asymmetrical image data voltage signals are applied on the source lines $S_m$ and $S_{m+1}$. Thus, the average between one frame of the potential variation of the pixel electrode 13 of the liquid crystal cell capacitor 15 is also reduced considerably due to no potential variation of the pixel capacitor 13 in the initial time intervals T1.

Such considerable reduction of the potential variation in the average for one frame suppresses the crosstalk to appear at the liquid crystal cell capacitor 15, thereby realizing an excellent and fine picture of the active matrix liquid crystal display.

As modifications of the second embodiment according to the present invention, the initial time intervals T1 and the latter time intervals T2 divided from every time intervals T within the frame are variable. It is possible that the initial and latter time intervals T1 and T2 could be equal to one another. It is also possible that the initial time intervals T1 could be longer than the latter time intervals T2. Eventually, the initial and latter time intervals T1 and T2, both of which are divided from the time intervals T of the frame, are variable by matching the liquid crystal condition, provided that the initial time intervals T1 in which the constant voltages are applied on the source lines 2 are much shorter than the response speed of the liquid crystal involved in the cell capacitor 15 so that the constant voltage signal does not appear on the liquid crystal display.

A third embodiment of the present invention will be described with reference to FIGS. 8 and 11.

A novel driving method of the third embodiment according to the present invention is basically analogous to that of the first and second embodiments, except for the wave-forms of the image data voltage signals. The wave-forms of the image data voltage signals to be applied on the source lines $S_m$ and $S_{m+1}$ are illustrated in FIG. 11.

In FIG. 11, $V_{Gn}$ is a wave-form of the gate control voltage signal as the scanning pulse to be applied on the gate line $G_n$. $V_{Gn+1}$ is a wave-form of the gate control voltage signal as the scanning pulse to be applied on the gate line $G_{n+1}$. $V_{COM}$ are wave-forms of the voltages to be applied to the opposite electrodes of the liquid crystal cell capacitors 15. The above wave-forms $V_G$, $V_{G+1}$ and $V_{COM}$ are the same as those of the first and second embodiments. The image data voltage signals have different wave-forms from that of the first and second embodiments according to the present invention. Namely, $+V_{sco3}$ and $-V_{sco3}$ are respectively positive and negative constant voltages, but both of which are so determined as to be respectively equal to center voltage values of the variable positive and negative image data voltage levels. Namely, the positive and negative constant voltages $+V_{sco3}$ and $-V_{sco3}$ correspond to the center voltage levels of the maximum and minimum image data voltage levels. This makes it easy to apply the voltage level as the image data signals to the pixel electrode 13 of the liquid crystal cell capacitor. $V_{Sm}$ and $V_{Sm+1}$ are wave-forms of the image data voltage signals to be applied on the source lines $S_m$ and $S_{m+1}$ respectively T is a time interval in which the image data voltage signal for each matrix cell or a pixel is applied on the source lines. Further, each of the time intervals T in which a single cell addressing is accomplished is divided into two time intervals, an initial time interval T1 and a latter time interval T2. Thus, the addition of the both time intervals T1 and T2 is equal to the time interval T. The above values of the time intervals T, T1 and T2 are variable but on condition that the addition of the initial and latter tine intervals T1 and T2 is equal to the time interval T.

Each of the image data voltage signals $V_{Sm}$ and $V_{Sm+1}$ has a wave-form of alternating voltage pulses, thereby resulting in the alternating driving of the liquid crystal cell. This secures long life time of the liquid crystal display. The polarity of each of the image data voltage signals $V_{Sm}$ and $V_{Sm+1}$ is inverted on every ON signal of the scanning pulses $V_{Gn}$ and $V_{Gn+1}$ applied on the gate lines $G_n$ and $G_{n+1}$. Namely, the image data voltage signal for a frame is the inverse of the image data voltage signal for the next frame.

Further, the image data voltage signals synchronizing with one another and being applied on the adjacent source lines $S_m$ and $S_{m+1}$ have opposite polarities relative to one another as illustrated in FIG. 11. Namely, the alternation of the image data voltage signals, source line by source line, is applied.

In every initial time interval T1, each of the image data voltage signals takes the positive or negative constant voltage value $+V_{sco3}$ or $-V_{sco3}$. In every latter time intervals T2, each of the image data voltage signals takes a voltage level corresponding to the image data which determines gray level of a pixel in the active matrix liquid crystal display. A single frame is defined by a time interval between a pulse and a next pulse of the gate control voltage.

The operation of the active matrix liquid crystal display will be described with reference to FIGS. 8 and 11.

For a first time interval T within one frame, the gate control voltage $V_{Gn}$ applied on the gate line $G_n$ takes a high digit value. The thin film field effect transistor 14 turns ON. The gate control voltage $V_{Gn}$ remains at the high digit value for the time interval T, in which the addressing for the cell capacitor 15 is accomplished. For the time interval T, the liquid crystal cell capacitor 15 serving as a memory cell takes a write-enable state.

With respect to the source line $S_m$, the image data voltage signal $V_{Sm}$ of the alternating voltage pulse is applied on the source line $S_m$. In the initial time interval T1 divided from the first time interval T of the frame, the positive constant voltage $+V_{sco3}$ is applied on the source line $S_m$. The positive constant voltage $+V_{sco3}$ applied to the liquid crystal cell capacitor 15 has no image data. In the latter time interval T2 divided from the first time interval T of the frame, a positive voltage level as the image data corresponding to a gray level of a pixel involved in the display is applied on the source line $S_m$. The positive image data voltage signal is transmitted through the thin film field effect transistor 14 to the pixel electrode 13 of the liquid crystal cell capacitor 15. As a result, the pixel electrode 13 takes the image data voltage level which makes the pixel show a required gray level. After the latter time interval T2 divided from the first time interval T of the frame, the gate control voltage signal which has been applied on the gate line $G_n$ becomes a low value. Then, the thin film field effect transistor 14 takes the OFF state. Then, the liquid crystal cell capacitor 15 stores and maintains the image data voltage signal until a next ON state of the thin film field effect transistor 14, thereby keeping the pixel electrode 13 at the image data voltage level for one frame. The absolute value of the image data voltage level determines the gray level of the pixel. Namely, the polarity of the image data voltage level is independent of the gray level of the pixel.

In contrast, in the first time interval T of the frame, the gate control voltage $V_{Gn+1}$ applied on the gate line $G_{n+1}$ takes a low digit value. Then, an adjacent thin film field effect transistor takes OFF state. The gate control voltage $V_{Gn+1}$ remains at the low digit value for the first time interval T in one frame. For the first time interval T in one frame, an adjacent liquid crystal cell capacitor serving as a memory cell takes a write-unable state.

With respect to the source line $S_{m+1}$, the image data voltage signal $V_{Sm+1}$ of the alternating voltage pulse being applied on the source line $S_{m+1}$ synchronizes but at the inverse polarity to the image data voltage signal $V_S$ applied on the source line $S_m$. In the initial time interval T1 divided from the first time interval T of the frame, the negative constant voltage $-V_{sco3}$ is applied on the source line $S_{m+1}$ but not applied to the adjacent liquid crystal cell capacitor. In the latter time interval T2 divided from the first time interval T of the frame, the negative image data voltage signal is also applied on the source line $S_{m+1}$ but not applied to the adjacent liquid crystal cell capacitor.

The liquid crystal cell capacitor 15 has a response speed of several ten milliseconds which is much longer than a single scanning time of several ten microseconds. This makes it impossible that a gray level corresponding to the positive constant voltage level $+V_{sco3}$ could appear on the pixel. A single frame comprises a much longer time than the response speed of the liquid crystal. For a single frame, the liquid crystal cell capacitor keeps the image data voltage level constant. This permits a gray level corresponding to the positive image data voltage level to appear on the pixel.

For a second time interval T in the frame, the gate control voltage $V_{Gn}$ applied on the gate line $G_n$ takes a low digit value. Thus, the thin film field effect transistor 14 takes OFF state. The gate control voltage $V_G$ remains at the low digit value for the second time interval T within the frame. For the second time interval T of the frame, the liquid crystal cell capacitor 15 serving as a memory cell takes a write-unable state.

With respect to the source line $S_m$, the image data voltage signal $V_{Sm}$ of the alternating voltage pulse is applied on the source line $S_m$. In the initial time interval T1 divided from the second time interval T of the frame, the negative constant voltage $-V_{sco}$ is applied on the source line $S_m$ but not applied to the adjacent liquid crystal cell capacitor. In the latter time interval T2 divided from the second time interval T of the frame, the negative constant voltage $-V_{sco3}$ is applied on the source line $S_m$ but not applied to the liquid crystal cell capacitor 15.

In contrast, in the second time interval T of the frame, the gate control voltage $V_{Gn+1}$ applied on the gate line $G_{n+1}$ takes a high digit value. The adjacent thin film field effect transistor turns ON. The gate control voltage $V_{Gn+1}$ remains at the high digit value for the second time interval T of the frame, in which the addressing for the adjacent cell capacitor is accomplished. For the second time interval T of the frame, the adjacent liquid crystal cell capacitor serving as a memory cell takes a write-enable state.

With respect to the source line $S_{m+1}$, the image data voltage signal $V_{Sm+1}$ of the alternating voltage pulse applied on the source line $S_{m+1}$ synchronizes with the image data voltage signal $V_S$ applied on the source line $S_m$ but at inverse polarity. In the initial time interval T1 divided from the second time interval T of the frame, the positive constant voltage $+V_{sco3}$ is applied on the source line $S_{m+1}$. The positive constant voltage $+V_{sco3}$ applied to the adjacent liquid crystal cell capacitor has no image data. Subsequently, in the latter time interval T2 divided from the second time interval T of the frame, a positive voltage level as the image data corresponding to a gray level of an adjacent pixel involved in the display is applied on the source line $S_{m+1}$. After the latter time interval T2 divided from the second time interval T of the frame, the gate control voltage signal which has been applied on the gate line $G_{n+1}$ takes a low value. Then, the adjacent thin film field effect transistor takes the OFF state. Then, the adjacent liquid crystal cell capacitor stores and maintains the image data voltage signal until a next ON state of the thin film field effect transistor, thereby keeping the pixel electrode at the image data voltage level for one frame.

Subsequently, the applications of such alternating pulse wave-forms $V_{Sm}$ and $V_{Sm+1}$ on the source lines $S_m$ and $S_{m+1}$ are continuously accomplished. After one frame, the gate control voltage signal $V_{Gn}$ takes the high value which makes the thin film field effect transistor 14 take ON state. The negative image data voltage signal $V_{Sm}$ is applied on the source line $S_m$, and then transmitted to the liquid crystal cell capacitor 15. Such driving method is so accomplished as to make the polarity of the liquid crystal capacitor alternate from positive to negative or from negative to positive, frame by frame. Thus, the liquid crystal cell capacitor 15 performs the alternating driving, frame by frame.

The quantity of crosstalk appearing on the pixel electrode 3 of the liquid crystal cell capacitor 15 will now be investigated. As described above, the potential variations $\Delta V_{LC1}$ and $\Delta V_{LC2}$ of the pixel electrode 3 of the liquid crystal cell capacitor 15 caused by the image data voltage signals applied on the source lines $S_m$ and $S_{m+1}$ are respectively given by the equations (1) and (2).

In the initial time interval T1 divided from each of the time intervals T of the frame, the source lines $S_m$ and $S_{m+1}$ are respectively applied with the constant voltage signals. The potential variations $\Delta V_{Sm}$ and $\Delta V_{Sm+1}$ of the pixel electrode 13 of the liquid crystal cell capacitor 15 are respectively given by:

$$\begin{aligned} \Delta V_{Sm} &= V_{sco3} - (-V_{sco3}) \\ &= 2V_{sco3}, \text{ and} \\ \Delta V_{Sm+1} &= (-V_{sco3}) - V_{sco3} \\ &= -2V_{sco3}. \end{aligned}$$

Then, the potential variation of the pixel electrode 13 of the liquid crystal cell capacitor 15 is given by addition of $\Delta V_{LC1}$ and $\Delta V_{LC2}$. Then, the potential variation is approximately zero. Thus, the potential variations $\Delta V_{LC1}$ and $\Delta V_{LC2}$ are canceled relative to one another thereby resulting in a zero crosstalk but only in the initial time intervals T1.

In the latter time interval T2 divided from each of the time intervals T, the potential variations $\Delta V_{Sm}$ and $\Delta V_{Sm+1}$ of the pixel electrode 13 of the liquid crystal cell capacitor 15 cancel one another but not completely, since the image data voltage levels are asymmetrical relative to one another. The potential variation of the pixel electrode 3 of the liquid crystal cell capacitor 15 is, however, reduced considerably, because the potential variation of the pixel electrode 13 occurs but only in the latter time intervals T2 in which the asymmetrical image data voltage signals are applied on the source lines $S_m$ and $S_{m+1}$. Thus, the average between one frame of the potential variation of the pixel electrode 13 of the liquid crystal cell capacitor 15 is also reduced considerably due to no potential variation of the pixel capacitor 13 in the initial time intervals T1.

Such considerable reduction of the potential variation in the average for one frame suppresses the crosstalk to appear at the liquid crystal cell capacitor 15, thereby realizing an excellent and fine picture of the active matrix liquid crystal display.

Figure 12:
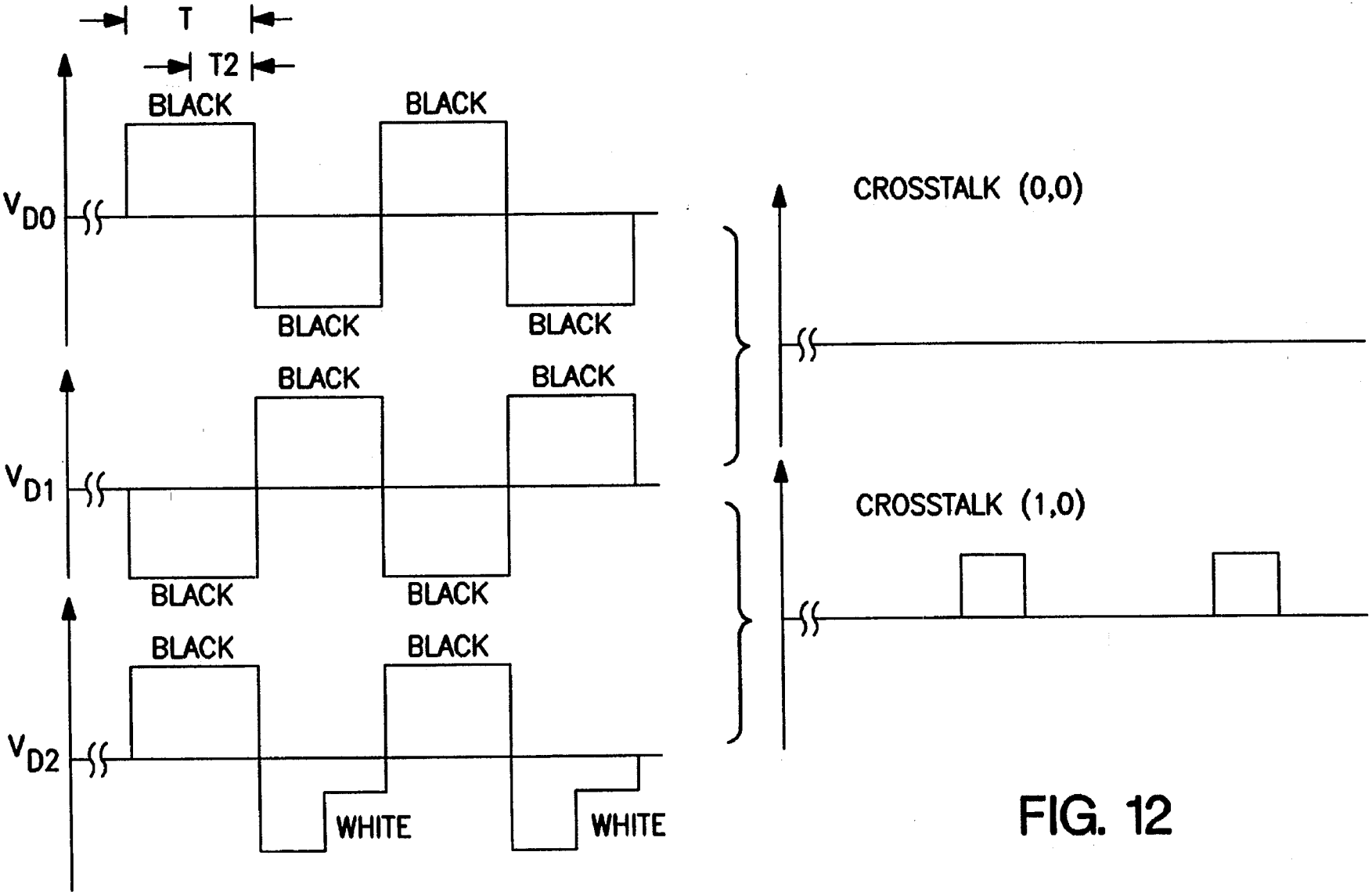
FIG. 12 is a view illustrative of wave-forms of image data voltage signals to be applied on column data lines for accomplishing the monotone display according to the present invention.

As modifications of the third embodiment according to the present invention, the initial and latter time intervals T1 T2 divided from every time intervals T within the frame are variable. It is possible that the initial and latter time intervals T1 and T2 could be equal to one another. It is also possible that the initial time intervals T1 could be shorter than the latter time intervals T2. Eventually, the initial and latter tine intervals T1 and T2, both of which are divided from the time intervals T of the frame, are variable by matching the liquid crystal condition, provided that the initial time intervals T1 in which the constant voltages are applied on the source lines 2 are much shorter than the response speed of the liquid crystal involved in the cell capacitor 15 so that the constant voltage signal does not appear on the liquid crystal display. By comparing the novel driving method of the present invention with the prior art, it will be clear that much of the crosstalk is reduced by the novel driving method of the present invention. Illustrated in FIG. 12 is one example of wave-forms to be applied on the data lines D0, D1 and D2 for accomplishment of the monotone displays. In FIG. 12, $V_{D1}$, $V_{D2}$ and $D_3$ are wave-forms of the image data voltage signals to be applied on the data lines $D_0$, $D_2$ and $D_3$ respectively. In this case, the active matrix liquid crystal display accomplishes the same monotone display pattern as the prior art as illustrated in FIG. 5.

The image data voltage signals applied on the data lines $V_{D0}$ and $V_{D1}$ are symmetrical relative to one another. Then, the cell capacitor (0,0) having the parasitic couplings with the data lines $D_0$ and $D_1$ suffers no affect due to the crosstalk. In contrast, the image data voltage signals applied on the data lines $V_{D1}$ and $V_{D2}$ are asymmetrical relative to one another. Then, the cell capacitor (1,0) having the parasitic couplings with the data lines $D_1$ and $D_2$ suffers an affect due to the crosstalk as illustrated in FIG. 12, but only in the latter time intervals T2 within the second and fourth time intervals T.

Figure 2:
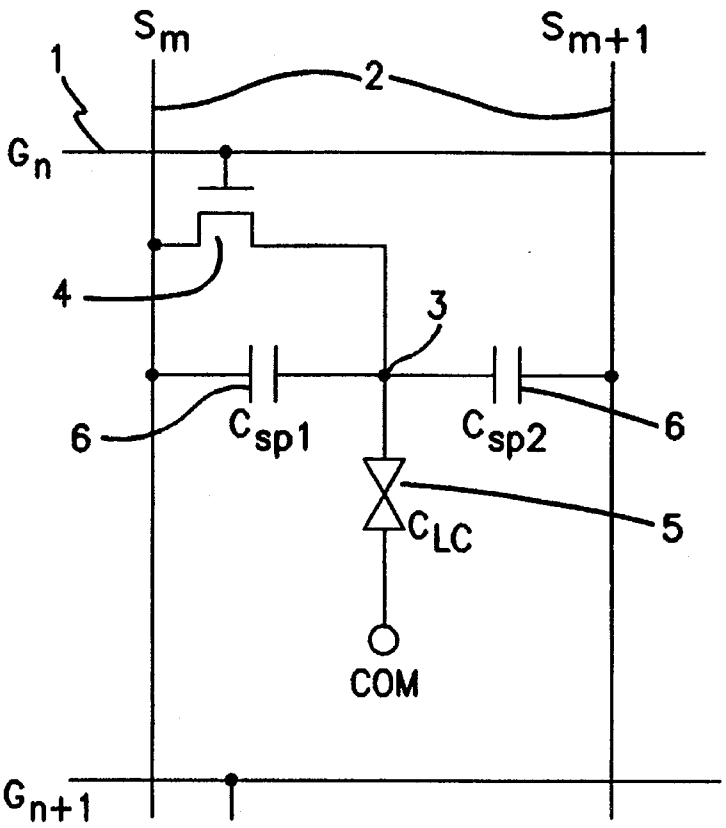
FIG. 2 PRIOR ART
FIG. 2 is a circuit diagram illustrative of the equivalent circuit of the active matrix cell illustrated in FIG. 1.
Figure 1:
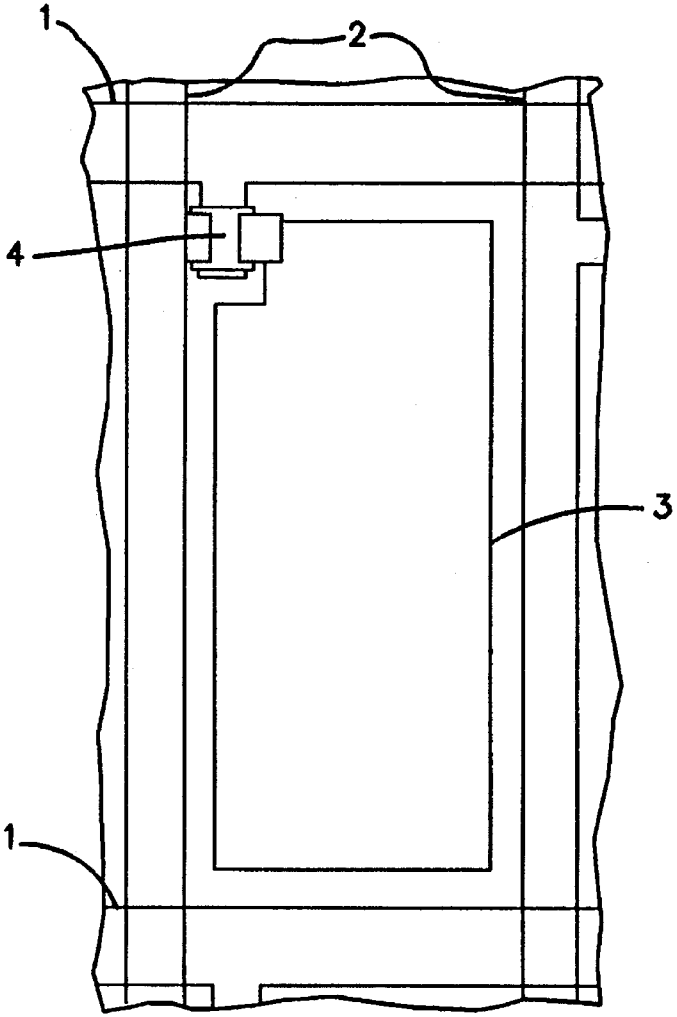
FIG. 1 PRIOR ART
FIG. 1 is a fragmentary cross sectional elevation view illustrative of the structure of each matrix cell involved in the active matrix liquid crystal display.
Figure 3A:
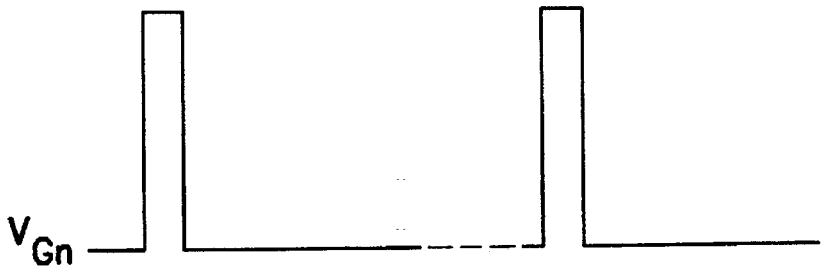
FIG. 3A PRIOR ART
FIGS. 3A–3D are views illustrative of wave-forms of gate control voltage signals of scanning pulses to be applied on row gate lines and image data voltage signals to be applied on column data lines in the prior art driving method.
Figure 3B:
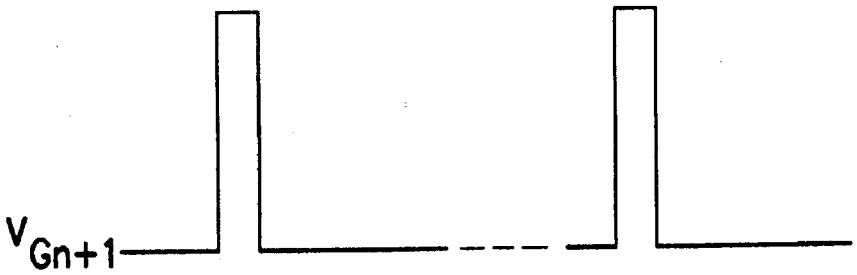
FIG. 3B PRIOR ART
Figure 3C:
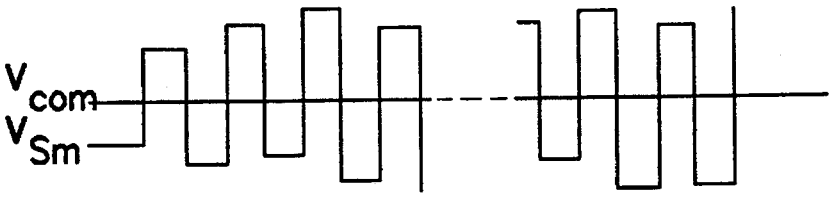
FIG. 3C PRIOR ART
Figure 3D:
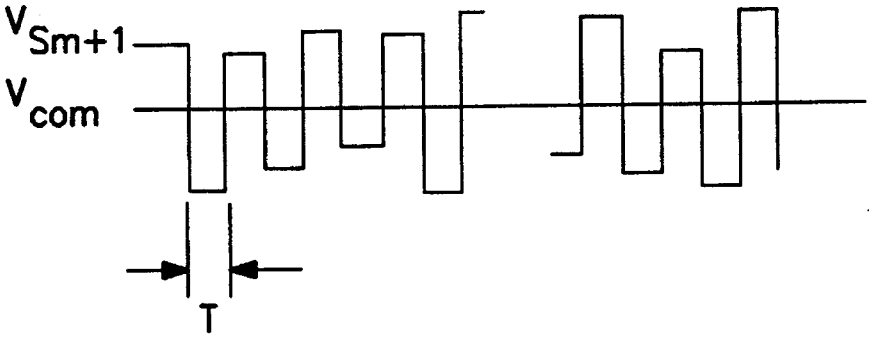
FIG. 3D PRIOR ART
Figures 4A, 4B, 4C, 4D, 4E:
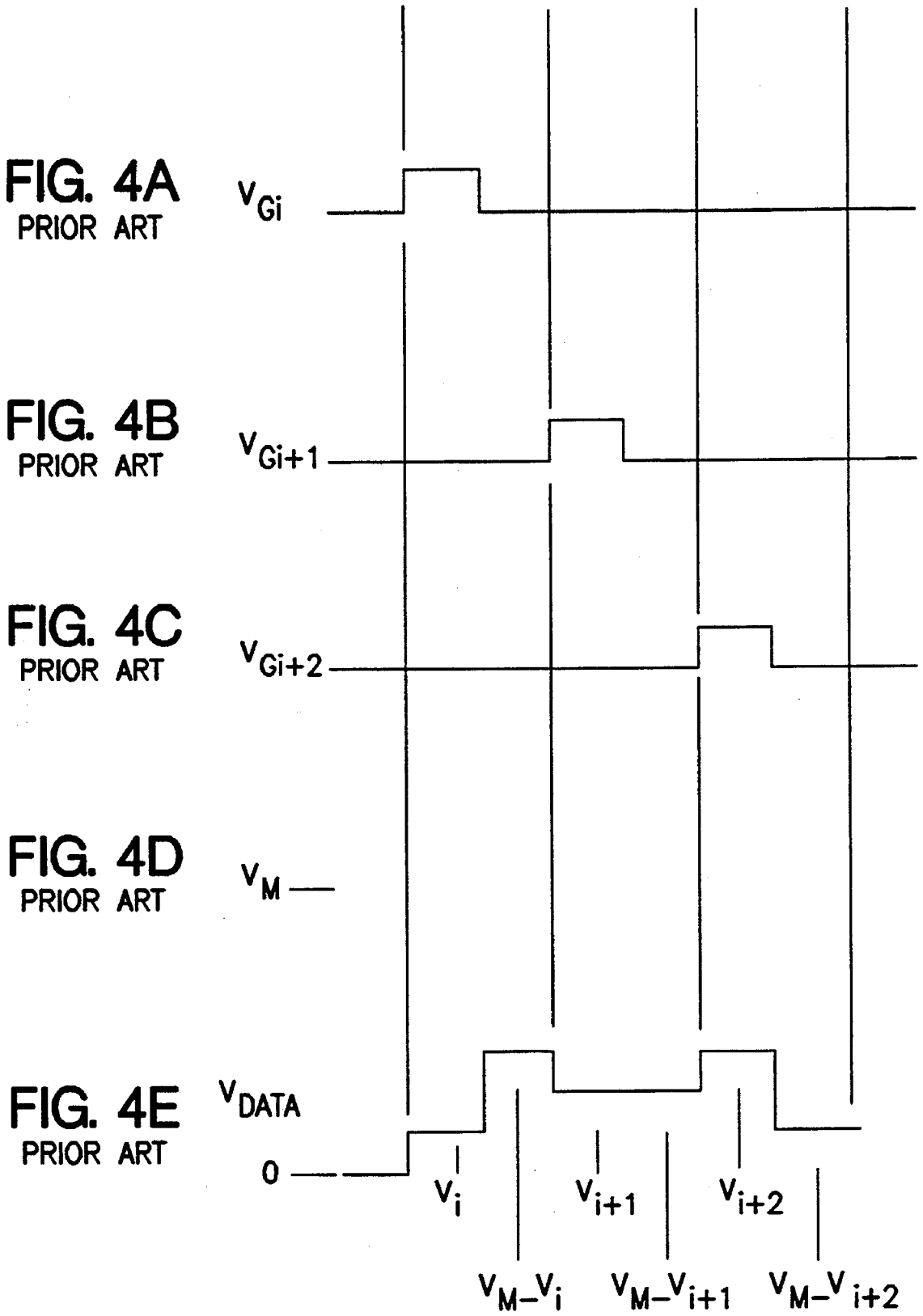
FIG. 4A PRIOR ART
FIG. 4B PRIOR ART
FIG. 4C PRIOR ART
FIG. 4D PRIOR ART
FIG. 4E PRIOR ART
FIGS. 4A–4E are views illustrative of wave-forms of gate control voltage signals of scanning pulses to be applied on row gate lines and image data voltage signals to be applied on column data lines in other prior art driving method.
Figure 5:
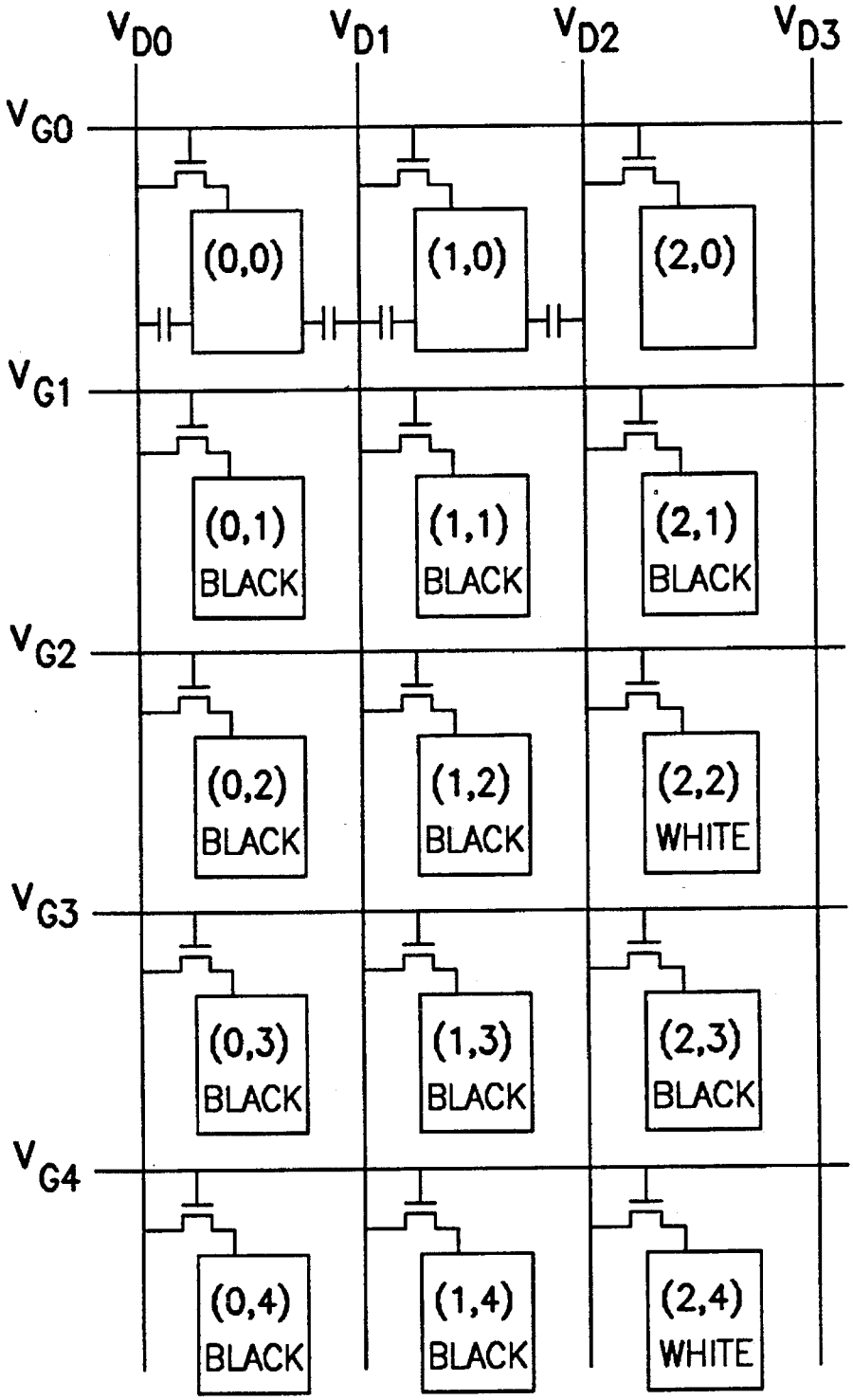
FIG. 5 is a circuit diagram illustrative of one example of monotone displays accomplished by an active matrix liquid crystal display.
Figure 6:
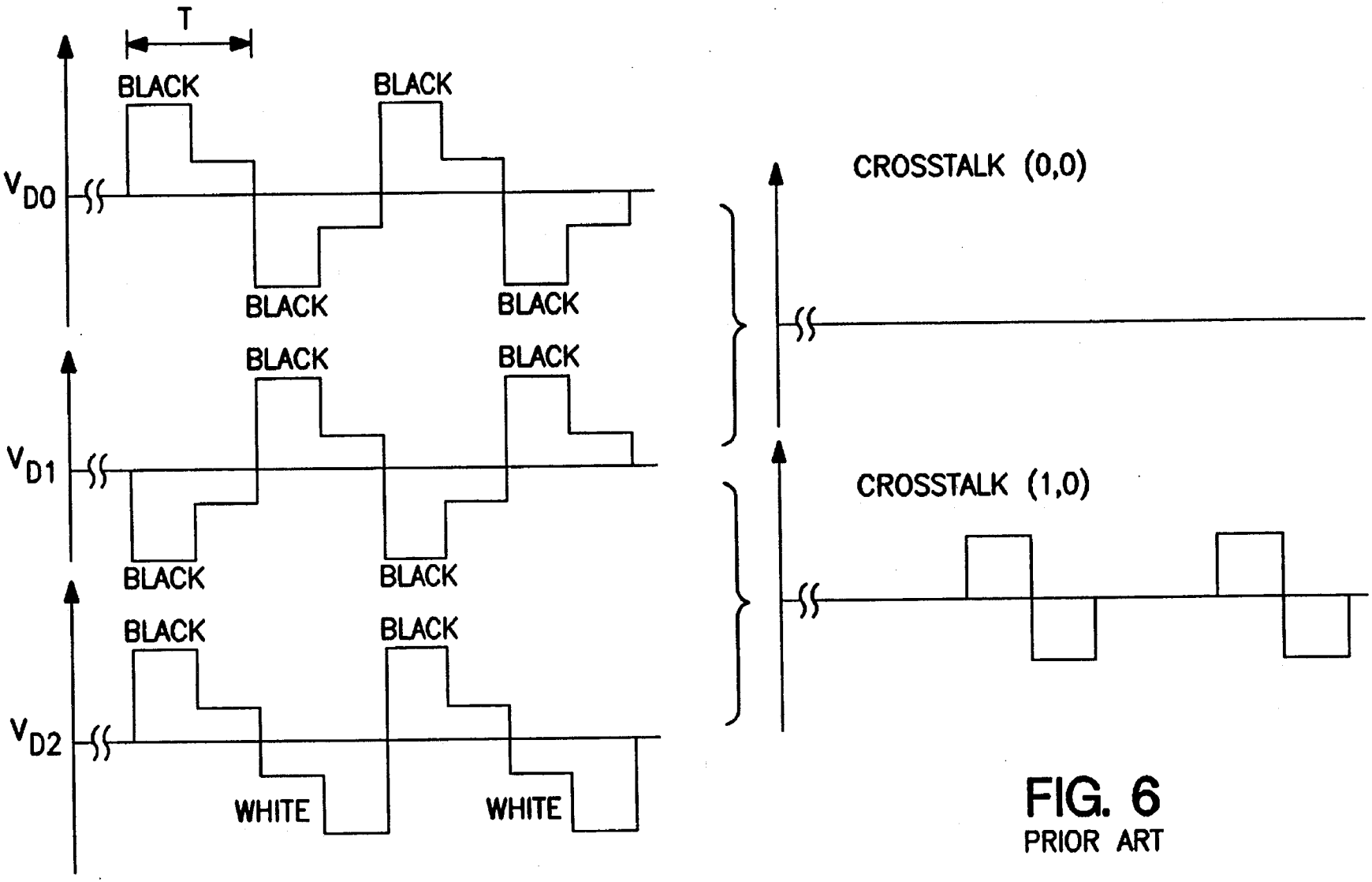
FIG. 6 PRIOR ART
FIG. 6 is a view illustrative of wave-forms of gate control voltage signals of scanning pulses to be applied on row gate lines and image data voltage signals to be applied on column data lines according to the prior art driving method illustrated in FIG. 5.

In the prior art as illustrated in FIG. 5, crosstalk appears not only in the latter time intervals T2 but also in the initial time intervals T1 within the second and fourth time intervals T. In contrast, in the present invention, crosstalk appears but only in the latter time intervals T2 within the second and fourth time intervals T. It is thus understood that the novel driving method of the present invention permits reducing the crosstalk appearing on the display by up to half.

As compared with the prior art, the novel driving method of the present invention allows considerable crosstalk reduction, because constant voltages are applied on the source lines to reduce the crosstalk instead of the data complement voltages used in the prior art.

Whereas modifications of the present invention will no doubt be apparent to a person of ordinary skill in the art, it is to be understood that the embodiments shown and described by way of illustration are by no means intended to be considered in a limiting sense. Accordingly, it is to be intended by claims to cover all modifications of the invention which fall within the spirit and scope of the invention.

What is claimed is:

1. A method of driving an active matrix liquid crystal thin-film-transistor (TFT) display device in which alternating pulse voltage signals synchronizing with gate control pulse voltage signals are applied on data lines, said method comprising the steps of:

applying predetermined positive and negative constant voltages not corresponding to image data on data lines in an initial time interval, said constant voltages to be applied on adjacent two lines having inverse polarities relative to one another, said constant voltages being independent from said image data;

subsequently applying voltage signals whose magnitude is modulated, at each of said gate control pulse voltage signals, by said image data on said data lines in a latter time interval, each of said voltage signals having a voltage level corresponding to a gray level of a pixel in said display, each of said applied voltage signals having the same polarity as said constant voltage; and continuing a pair of said first and second applying steps.

2. The driving method as claimed in claim 1, wherein said predetermined positive and negative constant voltages have an absolute value equal to a maximum value of said voltage signals corresponding to said image data.

3. The driving method as claimed in claim 1, wherein said predetermined positive and negative constant voltages have a larger absolute value than a maximum value of said voltage signals corresponding to said image data.

4. The driving method as claimed in claim 1, wherein said predetermined positive and negative constant voltages have center voltage values of said positive and negative voltage signals corresponding to said image data respectively.

5. The driving method as claimed in claim 1, wherein said initial time interval is shorter than said latter time interval.

6. The driving method as claimed in claim 1, wherein said initial time interval is longer than said latter time interval.

7. The driving method as claimed in claim 1, wherein said initial time interval is equal to said latter time interval.

8. The driving method as claimed in claim 1, wherein said polarity of said constant voltage and said voltage signals corresponding to said image data are alternated frame by frame.

* * * * *